US005765696A

United States Patent [19]

Pryor

[11] Patent Number: 5,765,696

[45] Date of Patent: Jun. 16, 1998

[54] RAPPED SIEVE BEND

[75] Inventor: Murray Pryor, Glebe, Australia

[73] Assignee: Minpro Australia N.L., New South Wales, Australia

[21] Appl. No.: 682,741

[22] PCT Filed: Jan. 23, 1995

[86] PCT No.: PCT/AU95/00032

§ 371 Date: Sep. 10, 1996

§ 102(e) Date: Sep. 10, 1996

[87] PCT Pub. No.: WO95/21032

PCT Pub. Date: Aug. 10, 1995

[30] Foreign Application Priority Data

Feb. 2, 1994 [AU] Australia ..... PM3658

[51] Int. Cl.[6] ..... B07B 1/06

[52] U.S. Cl. ..... 209/275; 209/382

[58] Field of Search ..... 209/274–277, 209/381, 382, 403

[56] References Cited

U.S. PATENT DOCUMENTS

| | | | |
|---|---|---|---|
| 4,288,320 | 9/1981 | Wilson . | |
| 4,505,812 | 3/1985 | Lees | 209/275 |
| 4,575,420 | 3/1986 | Blachetta et al. | 209/382 X |

FOREIGN PATENT DOCUMENTS

| | | | |
|---|---|---|---|
| 12997/83 | 6/1983 | Australia . | |
| 56276/90 | 12/1990 | Australia . | |
| 1586790 | 8/1990 | U.S.S.R. | 209/382 |
| 87/00093 | 1/1987 | WIPO . | |

*Primary Examiner*—Boris Milef
*Attorney, Agent, or Firm*—Spencer & Frank

[57] ABSTRACT

A sieve screen deck comprising having a frame and a sieve screen resiliently mounted to the frame so as to allow a limited amount of movement between the sieve screen and the frame. The sieve screen has flexible side walls. The screen deck also has a rapping mechanism which itself has a ram fixed at one end relative to the frame and acting at its other end on a drive shaft via a crank arm. The drive shaft extends across the sieve screen and is rotatably journalled in the respective side walls of the sieve screen. The rapping mechanism also has a rapping bar connected to the drive shaft by resilient elongate arms. The rams is actuated so as to move the rapping bar at intervals from a rest position wherein the rapping bar is spaced a short distance from the sieve screen and the sieve screen is supported by the frame to a primed position. In the latter portion, the rapping bar is spaced further away from the sieve screen and a predetermined distance above its rest position and the screen is raised relative to the frame and thereafter to release the mechanism to allow the rapping bar and the sieve screen to fall back to the rest position with such force that the rapping bar will cause the resilient arms to bend sufficiently to cause the rapping bar to strike the sieve screen.

7 Claims, 3 Drawing Sheets

RAPPED SIEVE BEND

The present invention relates to an improved sieve screen deck and more particular to a sieve screen deck in which the sieve screen is rapped in a novel manner to prevent blockage or blinding of the screen. The novel screen rapping mechanism is simple to make and install, and may improve the efficiency of operations of the sieve screen deck.

Known sieve screen decks are used to separate oversized and undersized particles from one another or to separate liquids from solids, or both simultaneously. Typically, a sieve screen deck comprises a frame, a sieve screen mounted on the frame and vibration means on the frame or the screen to cause the screen to vibrate. Originally, the screen was connected rigidly to the frame at either end, however, in more recent designs the ends of the screen are connected to the frame through flexible members which allow the screen to vibrate more freely and thus improve the screening action of the sieve screen deck.

It is known that the sieving action of such a screen deck may be enhanced by vibrating and/or rapping the screen, that is, by applying repeated impacts to one face of the screen or to the screen frame. Rapping is normally done by connecting a rapping bar to the underside of the sieve screen and positioning on the frame, or on the ground beneath the frame, a mechanical impacting means which imparts blows in rapid succession to the rapping bar or vibrates the complete screen and frame.

Whilst known rapping arrangements provide some alleviation to the problem of blinding of the sieve screen, it would be desirable to provide a more effective rapping action.

The present invention provides a sieve screen deck comprising:

a frame;

a sieve screen resiliently mounted to the frame so as to allow a limited amount of movement between the sieve screen and the frame, the sieve screen having flexible side walls; and a rapping mechanism having a ram fixed at one end relative to the frame and acting at its other end on a drive shaft via a crank arm, the drive shaft extending across the sieve screen and being rotatably journalled in the respective side walls of the sieve screen, the rapping mechanism also having a rapping bar connected to the drive shaft by resilient elongate arms;

means actuating the ram to cause it to move the rapping mechanism at intervals from a rest position wherein the rapping bar is spaced a short distance from the sieve screen and the sieve screen is supported by the frame, to a primed position wherein the rapping bar is spaced further away from the sieve screen and a predetermined distance above its rest position and the screen is raised relative to the frame and thereafter to release the mechanism to allow the rapping bar and the sieve screen to fall back to the rest position with such force that the rapping bar will cause the resilient arms to bend sufficiently to cause the rapping bar to strike the sieve screen.

In use, the ram is driven so as to exert an upward force on the crank arm to rotate the shaft and move the rapping bar upwards and away from the screen. The upward force exerted on the crank arm and an inertial or centrifugal force resulting from the rotational movement of the rapping bar causes a resultant upwardly directed force to be exerted on the shaft which is sufficient to move the sieve screen upwards relative to the frame. When the ram is released, the sieve screen will move under gravity back to a rest position relative to the frame to provide a first rap of the screen, and the rapping bar will also move downwards under gravity, the momentum of the rapping bar being sufficient to flex the resilient elongate arms and allow the rapping bar to move beyond its rest position and impact with the screen to provide a second rap in a flicking manner on the screen.

Preferably, the rapping mechanism is positioned above the sieve screen and the rapping bar impacts with the upper surface of the sieve screen.

Preferably, the ram is an hydraulic ram or a pneumatic ram having a cylinder and a piston driving a telescopic rod. Further, the ram preferably has a protective cover which encloses a part of the telescopic rod which is moved in and out of the cylinder during operation of the ram.

Preferably, the ram extends generally vertically upwards, from the crank arm with an upper end thereof being mounted directly or indirectly to the frame by a resilient mount which allows limited pivoting movement of the ram relative to the frame.

Preferably, the length of the resilient arm(s) is substantially greater than the length of the crank arm. More preferably, the resilient arm(s) are about four times the length of the crank arm.

The side walls of the sieve screen extend upwardly from the side edges of the sieve screen so as to prevent material falling over the side edges. The side walls may be formed of suitable synthetic plastics material or the like such as polyurethane and connected to the side edges of the screen. The plastics material should have sufficient resilience that vibration of the sieve screen is not substantially impeded. In a preferred embodiment of the present invention, the side walls are cast onto and bonded to the side edges of the sieve screen. In other embodiments, the side walls may be clipped on, screwed on or attached in any other suitable manner. It has been found suitable to form the side walls of polyurethane material which may be cast onto or formed separately and attached to the sieve screen.

It is found that the provision of flexible cast side walls on a self-supporting but flexible sieve screen prevents material flowing over the edges of the screen without impairing the ability of the screen to vibrate and flex under the action of the rapping mechanism. It is found that the freedom of the sieve screen to not only vibrate relative to its supporting frame but to also flex makes an important contribution to the efficiency of the sieve screen.

The sieve screen is preferably formed of a parallel array of wedge wires lying at right angles to the inclination of the screen. The wedge wires are preferably connected to an array of backing bars running longitudinally of the screen parallel to its fall line. The screen may be planar or may curve along its length to form a sieve bend.

In an alternative embodiment, the sieve screen comprises a sheet of metal into which an array of slots has been etched or otherwise formed. In this embodiment, the sheet may be inherently self-supporting or it may be supported by backing bars as described above.

In another alternative embodiment, the sieve screen is formed by casting a plastic material such as polyurethane into a form similar to that of wedge wires and backing bars, and wherein the sidewalls can be integrally formed.

The sieve screen is preferably formed with slots having a width of from 10 microns to 4 mm, most preferably the slots have a width of from 100 microns to 1 mm.

The frame of the sieve screen deck is of conventional construction and the screen is connected along its edges to the frame. The frame may be welded up from steel or formed in any other suitable manner. In one embodiment of the invention, the frame may completely surround the sieve screen, however, in other embodiments a plurality of sieve screens may be disposed in side by side array with a single frame supporting all of the sieve screens.

In another alternative embodiment, the drive shaft extending across the screen has two rapping bars connected to it by resilient elongate arms. As the second rapping bar tends to balance the first, the rapping action can no longer depend on gravity, and the ram is of the double acting variety.

The additional rapping bar is above the shaft, so that with the ram in the retracted position, the rapping bar is spaced a short distance from the sieve screen. The ram retracts at a rate which allows the inertia of rapping bar to flex the resilient elongate arms, and the rapping bar strikes the screen, after the ram reaches the retracted position.

In this embodiment, the forces exerted on the crank and the inertia of the rapping bar causes a resultant force on the screen, as in the first embodiment, and produces a similar "first rap" action.

The sieve screen is connected to the frame by resilient mounts. Preferably, one or both of the end edges of the sieve screen are connected to the frame through resilient members or like means which allow a limited amount of movement between the sieve screen and the frame. In a typical situation, the resilient members might allow a maximum movement of the sieve screen relative to the frame of about 2–10 mm.

Hereinafter given by way of example only, are preferred embodiments of the present invention described with reference to the accompanying drawings, in which.

Figure 3:
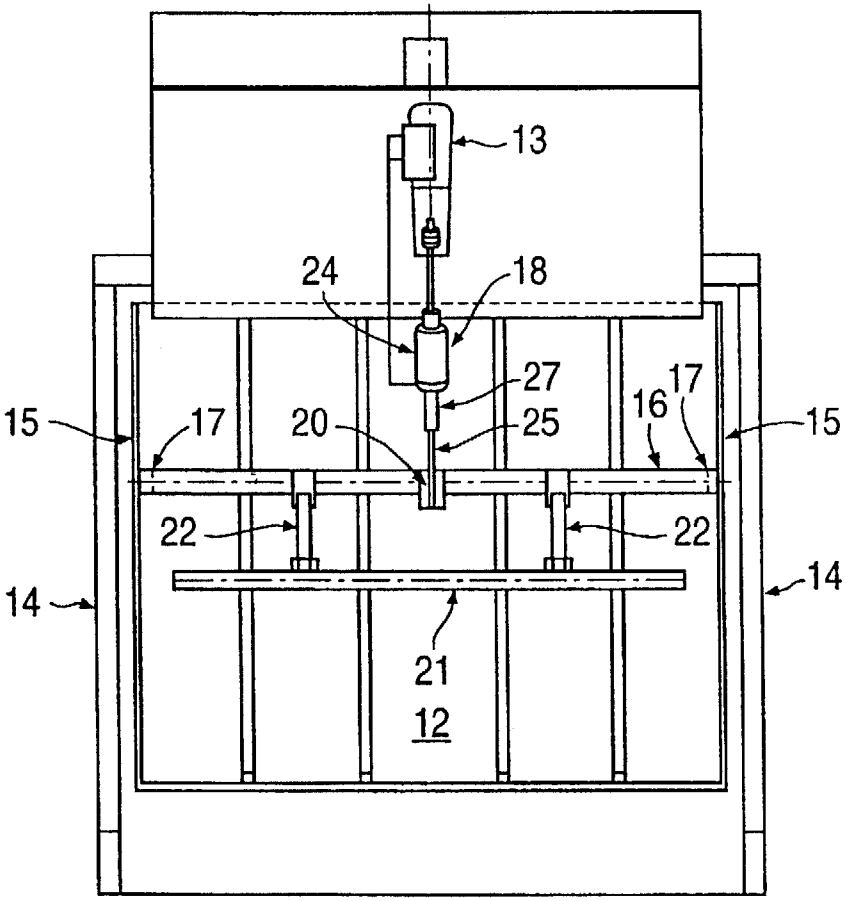
FIG. 3 is a front elevational view of the sieve screen deck of FIG. 1.
Figure 1:
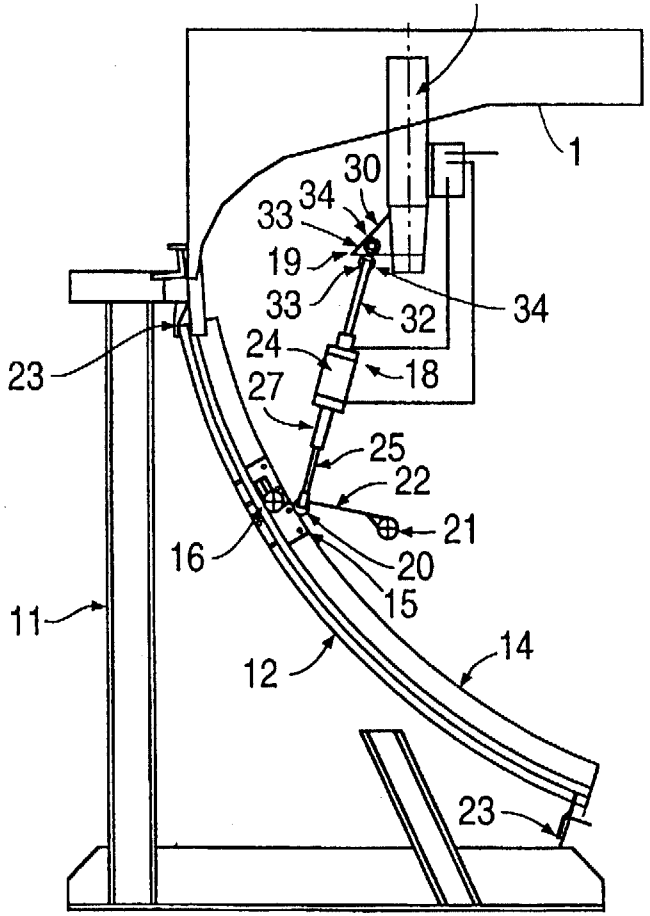
FIG. 1 is a side elevational view of a sieve screen deck including a rapping mechanism according to the present invention.

As seen in FIGS. 1 and 3, the sieve screen deck 10 includes a frame 11, a sieve screen 12 and a rapping mechanism 13.

The sieve screen 12 is fed by a distributor 1. The distributor 1 feeds a slurry onto the sieve screen 12. The sieve screen 12 is rapped by the rapping mechanism described in detail below.

The sieve screen 12 is supported at either end by a strip 23 of resiliently flexible material such as a rubber material of the type sold under the trade mark "LINARD". Alternatively, the strip 23 may be a polyurethane material which is cast on. In this way, the rapping force applied to the sieve screen 12 by the rapping mechanism can cause vibration over substantially the whole surface of the screen 12 without causing localised stresses. That is, the flexibility of the strips 23 and the fact that the screen is supported resiliently across its full width at either end allows for even distribution of the rapping forces.

As shown in FIG. 3, the screen 12 is provided on each of its longitudinal side edges with a flexible side wall 14. The side walls 14 are cast on from a flexible polyurethane material. The side walls 14 are provided with an enlarged or reinforced portion 15 which is used to support a shaft 16 of the rapping mechanism described below. The enlarged or reinforced portions 15 are each provided with a recess 17 which are used to journal respective end portions of the shaft 16 so that it is rotatably supported therein.

The rapping is controlled by control mechanism 13, and a pneumatic or hydraulic ram 18 fixed by a flexible mount 19 at its upper end relative to the frame 11. The ram 18 is pivotally connected at its lower end to a radially outer end of a crank arm 20 (see FIG. 2). The inner end of the crank arm 20 is connected to the drive shaft 16 which extends across the screen 12 and, as described above, is rotatably mounted to the side walls 14 of the screen 12.

A rapping bar 21 is mounted to the shaft 16 by a pair of resilient arms 22. The rapping bar 21 extends substantially across the width of the screen 12 generally parallel to the wedge wires 12*a* of the screen 12.

Figure 2:
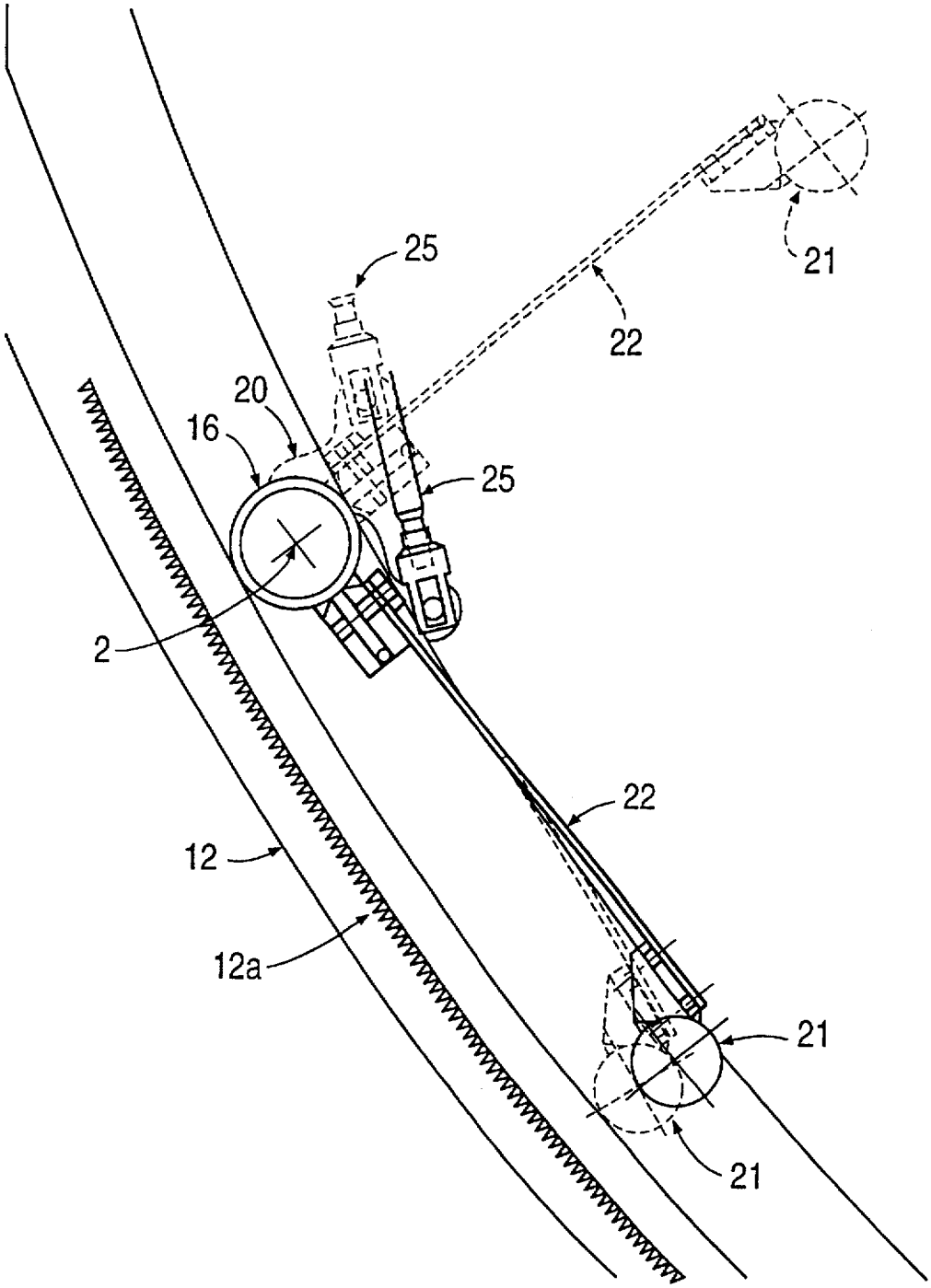
FIG. 2 is a detail side elevational view of the rapping mechanism shown in FIG. 1.

The apparatus described above is arranged so that, when it is in a rest position as shown in full lines in FIG. 2, the ram 18 is fully extended and the rapping bar is spaced a short distance from the surface of the screen 12. When the ram 18 is retracted, the drive shaft is caused to rotate so as to move the rapping bar 21 upwards and away from the surface of the sieve screen 12 to the upper position shown in broken lines in FIG. 2.

The length of the resilient arms 22 is substantially greater than the length of the crank arm 20. In the embodiment shown in the drawings, the resilient arms 22 are about four times the length of the crank arm 20.

The resilient mount 19 of the ram 18 relative to the frame 11 includes a bracket 30 having an oversized hole 31 which receives a threaded rod 32 forming an upper end of the ram 18. Resilient bushes 33 are provided on each side of the bracket 30, and also receive the rod 32. A pair of threaded nuts 34 engage on the rod 32 and clamp the bushes 33 and the bracket 30 therebetween. In this way, the mount 19 will resiliently allow a limited amount of pivoting movement of the ram 18 relative thereto.

The ram 18 includes a cylinder 24 and a piston (not shown) which drives a rod 25 telescopically received in the cylinder 24. The telescopic rod 25 of the ram 18 projects downwardly from the cylinder 24 and the distal end thereof is pivotally mounted to the outer end of the crank arm 20. In order to protect the upper part 26 of the telescopic rod 25 which moves in and out of the cylinder 24 during operation of the ram 18, a cover 27 is mounted to the cylinder 24 and extends downwardly and encloses the upper part of the telescopic rod 25. In this way, the material flowing down the sieve screen 12 is generally prevented from contacting that part of the telescopic rod 25 so as not to foul the operation of the ram 18.

The apparatus described above is so arranged that when it is in use, the rod 25 of the ram 18 is retracted under the action of the control mechanism 13 so as to move the rapping bar 21 away from its rest position (shown in solid lines in FIG. 2) upwards and away from the surface of the screen 12. The force required to move the rapping bar 21 is a generally vertical upward force which acts on the outer end of the crank arm 20. The rotational movement of the rapping bar on the end of the resilient arms 22 creates an inertial or centrifugal force which acts generally tangentially to the axis 2 of the drive shaft 16 such that there is a resultant generally vertical force applied to the drive shaft 16 which serves to lift the sieve screen 12 upwards relative to the frame 11. When the ram has been retracted to a predetermined position by control mechanism 13, it is then released allowing the sieve screen 12 and the rapping bar 21 to fall by gravity. The sieve screen 12 will come to an abrupt stop at its rest position relative to the frame 11 causing a first rap on the screen which serves to dislodge material trapped between the wedge wires of the screen. Further, the rapping bar will move downwards and towards its rest position (i.e. which corresponds to an end stop of the ram 18) and, due to the momentum of the rapping bar 21, the resilient arms 22 will flex allowing the rapping bar 21 to continue to move past its rest position and to impact against the screen 12 as illustrated in the lower position shown in broken lines in FIG. 2 thus causing a second rapping of the screen 12. After the impact, the rapping bar 21 will be caused to move back to its rest position spaced a short distance from the surface of the sieve screen 12 by the resiliency of the arms 22. In this way, the rapping bar 21 is caused to flick against the sieve screen 12.

The dual rapping action caused by the sieve screen 12 abruptly stopping in its rest position with the frame 11, and of the rapping bar 21 impacting with the screen 12, are caused to occur consecutively so as to provide a double rapping of the screen 12 with each stroke of the ram 18.

In the above described embodiment, the rapping mechanism is conveniently mounted above the screen 12 and the rapping bar 21 is caused to rap against the upper surface of the screen 12. In an alternative embodiment (not shown) the rapping mechanism can be mounted below the screen 12 with the rapping bar 21 being caused to rap against the lower surface of the screen 12. A problem with the alternative embodiment, is that the rapping mechanism is more exposed to and would be constantly covered by the material which passes through the screen.

In use, a slurry or like feed stock is fed onto the distributor 1 and flows evenly onto the sieve screen 12. As the slurry flows down the sieve screen 12, the screen 12 is caused to be rapped by the rapping mechanism 13. It has been found that the double rapping action of the rapping mechanism 13 renders the sieve screen deck 10 less susceptible to blinding than conventional sieve screen decks.

Figure 5:
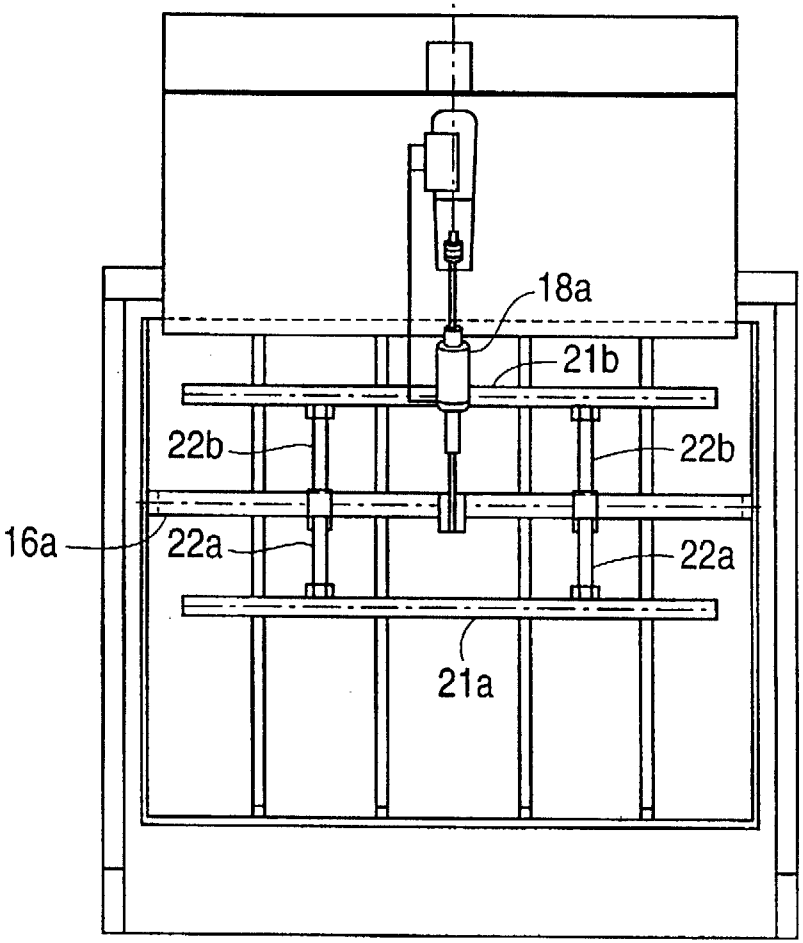
FIG. 5 is a front elevational view of the construction shown in FIG. 4.
Figure 4:
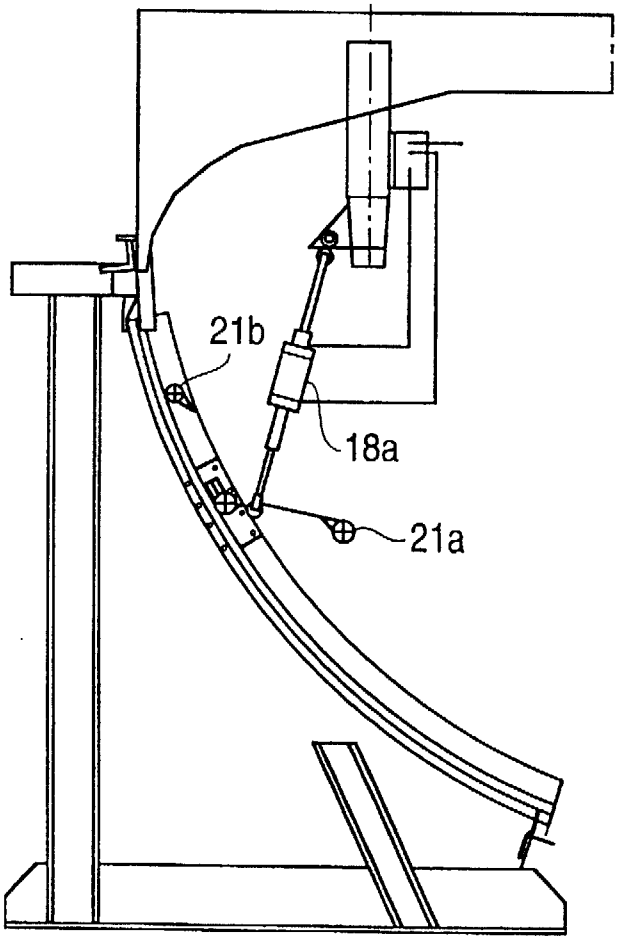
FIG. 4 is a view similar to FIG. 1 showing an alternative form of construction utilising two rapping bars.

FIGS. 4 and 5 illustrate an alternative form of the invention in which two rapping bars are employed. The construction shown in these figures is essentially the same as that illustrated in FIGS. 1–3 and the construction will be described only insofar as it relates to features of construction that are different from those described in connection with the previous figures. In FIGS. 4 and 5, a drive shaft **16*a* has two rapping bars 21*a* and 21*b* connected to it by resilient elongated arms 22*a* and 22*b*. The drive shaft 16*a* is rotated in the same manner as the drive shaft 16 of FIG. 1. As the second rapping bar 21*b* tends to balance the first 21*a* the rapping action can no longer depend on gravity and the ram 18*a*** is of the double acting variety.

The additional rapping bar **21*b* is above the shaft 16*a* so that with the ram 18*a* in the retracted position, the rapping bar 21*b* is spaced a short distance from the sieve screen 12. The ram 18*a* retracts at a rate which allows the inertia of the rapping bars to flex the resilient elongated arms 22*b*** and the rapping bar strikes the screen after the ram reaches the retracted position. In this embodiment, the force is exerted on the crank and the inertia of the rapping bar cause a resultant force on the screen as in the first embodiment and produces a similar "first rap" action. This gives approximately twice the rapping frequency at the same cylinder rod velocity. The rapping does not depend on gravity so it can be more easily applied to the back of the screen.

It will be appreciated by persons skilled in the art that numerous variations and/or modifications may be made to the invention as shown in the specific embodiments without departing from the spirit or scope of the invention as broadly claimed. The present embodiments are, therefore, to be considered in all respects as illustrative and not restrictive.

I claim:

1. A sieve screen deck comprising:

a frame;

a sieve screen resiliently mounted to the frame so as to allow a limited amount of movement between the sieve screen and the frame, the sieve screen having flexible side walls; and a rapping mechanism having a ram fixed at one end relative to the frame and acting at its other end on a drive shaft via a crank arm, the drive shaft extending across the sieve screen and being rotatably journalled in the respective side walls of the sieve screen, the rapping mechanism also having a rapping bar connected to the drive shaft by resilient elongate arms, means actuating the ram to cause the ram to move the rapping bar at intervals from a rest position wherein the rapping bar is spaced a short distance from the sieve screen and the sieve screen is supported by the frame, to a primed position wherein the rapping bar is spaced further away from the sieve screen and a predetermined distance above its rest position and the screen is raised relative to the frame and thereafter to release the mechanism to allow the rapping bar and the sieve screen to fall back to the rest position with such force that the rapping bar will cause the resilient arms to bend sufficiently to cause the rapping bar to strike the sieve screen.

2. A sieve screen deck as claimed in claim 1 wherein the rapping mechanism is positioned above the sieve screen and the rapping bar impacts with the upper surface of the sieve screen.

3. A sieve screen deck as claimed in claim 2 wherein the ram extends vertically upwards, from the crank arm with an upper end thereof being mounted directly or indirectly to the frame by a resilient mount which allows limited pivoting movement of the ram relative to the frame.

4. A sieve screen deck as claimed in claim 2 wherein the drive shaft is provided with an additional rapping bar supported by resilient elongate arms projecting from the drive shaft in a direction opposite to the first mentioned resilient elongate arms, the arrangement being such that the additional rapping bar is caused to strike the sieve screen when the first mentioned rapping bar is moved to the primed position.

5. A sieve screen deck as claimed in claim 1 wherein the ram extends vertically upwards, from the crank arm with an upper end thereof being mounted directly or indirectly to the frame by a resilient mount which allows limited pivoting movement of the ram relative to the frame.

6. A sieve screen deck as claimed in claim 5 wherein the drive shaft is provided with an additional rapping bar supported by resilient elongate arms projecting from the drive shaft in a direction opposite to the first mentioned resilient elongate arms, the arrangement being such that the additional rapping bar is caused to strike the sieve screen when the first mentioned rapping bar is moved to the primed position.

7. A sieve screen deck as claimed claim 1 wherein the drive shaft is provided with an additional rapping bar supported by resilient elongate arms projecting from the drive shaft in a direction opposite to the first mentioned resilient elongate arms, the arrangement being such that the additional rapping bar is caused to strike the sieve screen when the first mentioned rapping bar is moved to the primed position.

* * * * *